United States Patent [19]

Zorn et al.

[11] Patent Number: 4,876,997

[45] Date of Patent: Oct. 31, 1989

[54] SELF-ADJUSTING HYDRAULIC VALVE TAPPET

[75] Inventors: Helmut Zorn; Georg Schaeffler, both of Herzogenaurach, Fed. Rep. of Germany

[73] Assignee: INA Walzlager Schaeffler KG, Fed. Rep. of Germany

[21] Appl. No.: 316,467

[22] Filed: Feb. 27, 1989

[30] Foreign Application Priority Data

Mar. 26, 1988 [DE] Fed. Rep. of Germany ..... 3810436

[51] Int. Cl.[4] ..... F01L 1/14; F01L 1/24

[52] U.S. Cl. ..... 123/90.52; 123/90.55

[58] Field of Search ..... 123/90.52, 90.53, 90.55, 123/90.57, 90.56

[56] References Cited

U.S. PATENT DOCUMENTS

| | | | |
|---|---|---|---|
| 4,373,477 | 2/1983 | Buente et al. | 123/90.55 |
| 4,465,038 | 8/1984 | Speil | 123/90.55 |
| 4,590,898 | 5/1986 | Buente et al. | 123/90.55 |
| 4,648,360 | 3/1987 | Schaeffler | 123/90.55 |
| 4,709,668 | 12/1987 | Klug et al. | 123/90.55 |
| 4,721,076 | 1/1988 | Goppelt et al. | 123/90.55 |
| 4,745,889 | 5/1988 | Speil | 123/90.55 |
| 4,782,799 | 11/1988 | Goppelt et al. | 123/90.55 |

FOREIGN PATENT DOCUMENTS

| | | | |
|---|---|---|---|
| 3542192 | 6/1987 | Fed. Rep. of Germany | 123/90.55 |

*Primary Examiner*—Charles J. Myhre
*Assistant Examiner*—Weilun Lo
*Attorney, Agent, or Firm*—Bierman and Muserlian

[57] ABSTRACT

A self-adjusting hydraulic valve tappet arranged in a guide bore of a cylinder head of an internal combustion engine against whose one end face a cam abuts and whose other end face lies against a valve stem which avoids the disadvantages of the prior art and achieves a durable self-tightness of the sleeve with respect to the oil reservoir independently of the deflections of the end member by using simple constructional and particularly hardly more expensive means.

8 Claims, 2 Drawing Sheets

SELF-ADJUSTING HYDRAULIC VALVE TAPPET

STATE OF THE ART

Self-adjusting hydraulic valve tappets of this type are known in which the leak-tight joint between the inner surface of the end member and the sleeve is achieved by a butt weld in DE-OS 3,542,192. Practice has shown that the slight dynamic deflections of the end member occurring in operation when the cam abuts against it, load the weld seam to such an extent that it frequently fractures after a certain operation time. Even though by this, the tappet does not become inoperative, the advantages gained by this arrangement of the sleeve are, however, lost.

OBJECTS OF THE INVENTION

It is an object of the invention to eliminate this disadvantage and achieve a durable leak-tightness of the sleeve with respect to the oil reservoir independently of the deflections of the end member by using simple constructional and particularly hardly more expensive means.

This and other objects and advantages of the invention will become obvious from the following detailed description.

THE INVENTION

The self-adjusting hydraulic valve tappet of the invention arranged in a guide bore of a cylinder head of an internal combustion engine against whose one end face a cam abuts and whose other end face lies against a valve stem whereby the valve tappet comprises a cup-shaped housing made up of a hollow cylindrical wall closed at one end by an end member against whose outer surface the cam abuts and in which a guide sleeve is arranged concentrically with the hollow cylindrical wall, the guide sleeve opening at its end away from the end member into the center of a disk member which at its outer periphery verges into the hollow cylindrical wall of the housing and which guide sleeve at its other end is at a distance from the end member whereby the actual play compensating element is mounted in the guide sleeve for longitudinal displacement and is comprised of an inner piston and an outer overlapping piston placed within one another for longitudinal displacement, and together defining a high-pressure oil reservoir connected with a central oil reservoir by a bore in the inner piston closed by a check valve, the central oil reservoir being located in the inner piston and defined by the wall of the inner piston and by the inner surface of the end member of the housing against which the inner piston sits close with its end face whereas the outer piston is mounted in the cylindrical guide sleeve for longitudinal displacement and lies against the end of the valve stem with its closed end whereby an annular oil reservoir is defined by the hollow cylindrical wall, the guide sleeve, the hydraulic play compensating element, the end member and the disk member and fed with oil through a bore leading to the outside and whereby a sleeve starting from the end member is provided which overlaps the guide member and extends to near the disk member forming a channel between the sleeve and the guide sleeve which permits the transfer of oil from the annular oil reservoir to an annular space defined by the sleeve and the inner piston, is characterized in that the sleeve is provided at its end adjacent to the end member with an outwardly directed radial flange extending up to the bore of the hollow cylindrical wall. These features provide that the joint between the sleeve and the cup-shaped housing is located in a region which is not influenced by the deflections of the end member during operation.

In a preferred embodiment of the invention, the flange is provided at its radially outer edge with a short cylindrical collar directed axially away from the end member and snugly fitting into the bore of the hollow cylindrical wall. In individual cases, it often suffices to press the axially directed collar with an adequate pretension into the bore of the hollow cylindrical wall of the cup-shaped housing to achieve a durable joint. If necessary, however, it is equally feasible to weld the free edge of the collar at some points of its periphery to the hollow cylindrical wall or to fix it there by plastic deformation of the wall.

In all cases, it is possible to completely exclude any influence of the deflections of the end member on the flange and thus on the weld seam in case this is used for fixing, either by providing a close fit between the end member of the cup-shaped housing and the flange, which starting from the sleeve is directed radially towards the exterior or by arranging the flange at a slight distance from the end member. By providing a slight inclination of the flange, the contact with the inner surface of the end member can be restricted to the radially outermost region of the flange. It can, however, also be supported on a shoulder of the hollow cylindrical wall so that any contact with the inner surface of the end member is avoided. It is also possible to design the sleeve in such a way that its end away from the end member is propped against the disk member which results in a clamp joint providing a secure hold for the sleeve and the flange connected with it.

The invention can also be employed with advantage in the case of a known valve tappet in which a cylindrical jacket is fitted inside against the bore of the hollow cylindrical wall to which it is attached at its end away from the end member in a leak-tight manner defining together with the wall a longitudinal channel at at least one point of its periphery, this channel being connected with an oil filling bore at its end away from the end member and opening into the oil reservoir at its other end situated towards the end member. In such tappets, it is advantageous to design and dimension the cylindrical jacket so that its end face situated towards the end member supports the cylindrical collar of the radial flange.

Referring now to the drawings.

Figure 1:
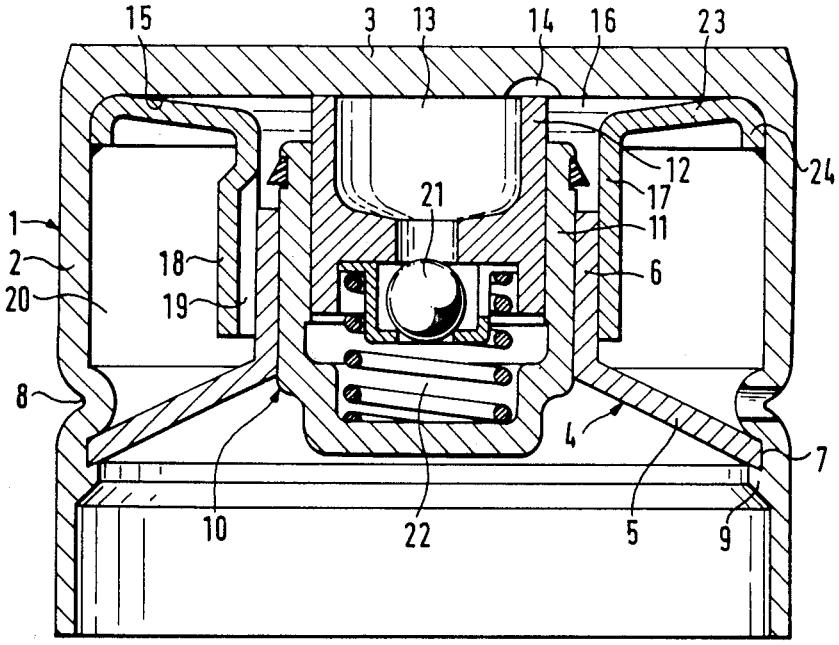
FIG. 1 is a longitudinal cross-section of a valve tappet of the invention.

In all the figures, the valve tappet consists of a cup-shaped housing 1 consisting of a hollow cylindrical wall 2 and end member 3 integral with it. In this housing, an inner member 4 comprising a disk member 5 and a cylindrical sleeve 6 is arranged. At the contact face 7 between the outer periphery of the disk member 5 and the hollow cylindrical wall 2, these two parts are firmly connected to each other by crimping. To achieve a liquid-tight joint, additional measures like welding, soldering or the like may be used. To make the joint, the disk member 5 fits against the circumferential groove 8 formed in the hollow cylindrical wall and on the other side, it is covered by the bead 9 resulting in the hollow cylindrical wall.

In the bore of the cylindrical guide sleeve 6, the hydraulic play compensating element 10 is mounted which consists of an outer piston 11 placed for sliding movement in the guide sleeve 6 and receiving in its turn, also with sliding movement and very little play, the inner piston 12. The latter is provided at its end facing the end member 3 with an oil reservoir 13 which communicates with an annular space 16 by means of the cut-out 14 in the inner surface 15 of the end member 3, the annular space 16 being defined on one side by the inner piston 12 and on the other side by a sleeve 17 which extends from the end member 3 over the cylindrical sleeve 6 to near the disk member 5. The sleeve 17 is dimensioned so that it overlaps the guide sleeve 6 on the outside and has at least one longitudinally extending groove 18 formed into its periphery which together with the guide sleeve 6 defines a longitudinal channel 19 through which oil can be transferred from the outer annular oil reservoir 20 into the annular space 16 and from there finally to the central oil reservoir 13. From here, the oil is transferred in a known manner through the check valve 21 into the high-pressure oil reservoir 22.

In FIG. 1, the sleeve 17 is attached to the housing 1 by a radial flange 23 at its end adjacent to the end member 3, the flange being slightly inclined and directed towards the outside and extending up to the bore of the hollow cylindrical wall 2 where it forms a short cylindrical collar 24 directed axially away from the end member 3 and snugly fitting into the bore of the hollow cylindrical wall 2 to form a durable joint. If deemed necessary, the free end of the collar 24 can be additionally welded to the bore of the wall 2.

Figure 2:
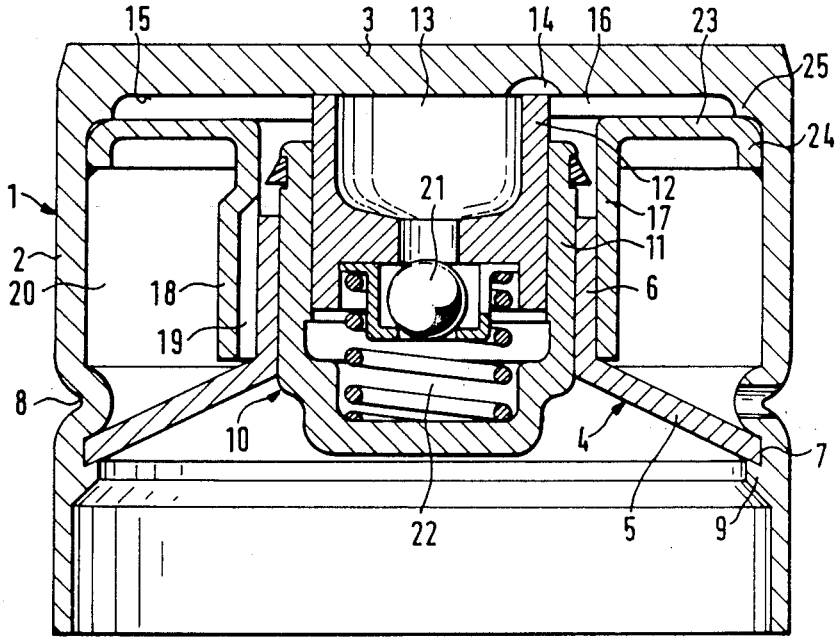
FIGS. 2 to 4 are longitudinal cross-sections of different embodiments of valve tappets of the invention.

The embodiment of FIG. 2 differs from that of FIG. 1 by the fact that the flange 23 is propped against a shoulder 25 of the hollow cylindrical wall 2, thus avoiding contact with the inner surface 15 of the end member 3. At the same time, the sleeve 17 reaches down to the disk member 5 with its end away from the end member 3 to form a firm clamp joint.

Figure 3:
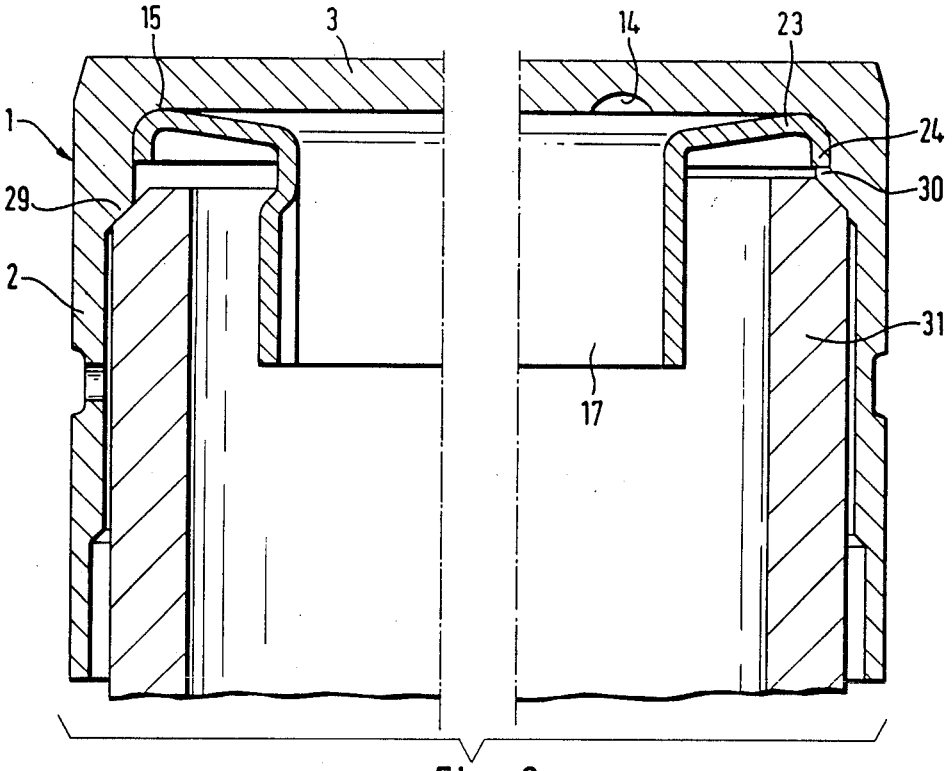

According to FIG. 3, which shows only the housing 1 with the sleeve 17 of a cup tappet, the joint between the free end of the cylindrical collar 24 of the outwardly directed flange 23 and the hollow cylindrical wall 2 is made after the placement of the sleeve 17 in the housing 1 by cold flow deformation of the material of the wall 2 in the region of a wall shoulder 29 so that the resulting bead 30 presses against the annular end face of the cylindrical collar 24. Such a joint can be made by using an annular die 31 as caulking tool, which is pressed axially into the housing 1. The left half of FIG. 3 shows the annular die 31 before the cold working of the wall 2, whereas in the right half, the annular die 31 and the bead 30 formed in the wall 2 after cold working, can be seen. Instead of a continuous bead all around the wall, individual retaining projections for the sleeve 17 can be formed at some points of the wall 2. In this case, the annular die 31 is provided with projections, the outer edges of which lie on a diameter larger than the diameter of the collar 24.

Figure 4:
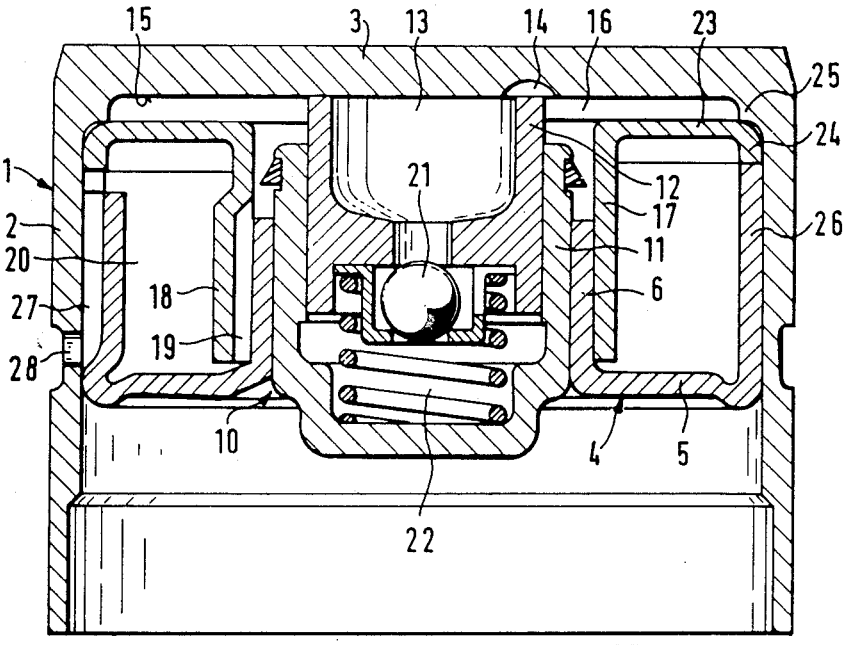

In the valve tappet shown in FIG. 4, the radially outer edge of the disk member 5 continues to form a cylindrical jacket 26 whichlies closely against the bore of the hollow cylindrical wall 2 and which is made in one piece with the inner element 4. At one point of its periphery, this cylindrical jacket 26 together with the wall 2 defines a longitudinal channel 27 which is connected by an oil feeding bore 28 at its end away from the end member 3 and which opens into the oil reservoir 20 at its end situated towards the end member 3. In the represented embodiment, the cylindrical collar 24 of the flange 23 is supported by the end face of the cylindrical jacket 26 facing the end member 3 and is sufficiently firmly fixed in this manner without the need of additional fixing means.

Various modifications of the tappets of the invention may be made without departing from the spirit or scope thereof and it is to be understood that the invention is intended to be limited only as defined in the appended claims.

What we claim is:

1. A self-adjusting hydraulic valve tappet arranged in a guide bore of a cylinder head of an internal combustion engine against whose one end face a cam abuts and whose other end face lies against a valve stem whereby the valve tappet comprises a cup-shaped housing made up of a hollow cylindrical wall closed at one end by an end member against whose outer surface the cam abuts and in which a guide sleeve is arranged concentrically with the hollow cylindrical wall, the guide sleeve being integrally formed at its end away from the end member with a disk member which at its outer periphery verges into the hollow cylindrical wall of the housing and which guide sleeve at its other end is at a distance from the end member where in an actual play compensating element is mounted in the guide sleeve for longitudinal displacement and is comprised of an inner piston and an outer overlapping piston placed within one another for longitudinal displacement, and together defining a high-pressure oil reservoir connected with a central oil reservoir by a bore in the inner piston closed by a check valve, the central oil reservoir being located in the inner piston and defined by the wall of the inner piston and by the inner surface of the end member of the housing against which the inner piston sits close with its end face whereas the outer piston is mounted in the cylindrical guide sleeve for longitudinal displacement and lies against the end of the valve stem with its closed end wherein an annular oil reservoir is defined by the hollow cylindrical wall, the guide sleeve, the actual play compensating element, the end member and the disk member and fed with oil through a bore leading to the outside and wherein a sleeve starting from the end member is provided which overlaps the guide sleeve and extends to near the disk member forming a channel between the sleeve and the guide sleeve which permits the transfer of oil from the annular oil reservoir to an annularspace defined by the sleeve and the inner piston, characterized in that the sleeve is provided at its end adjacent to the end member with an outwardly directed radial flange extending to the hollow cylindrical wall.

2. A valve tappet of claim 1 wherein a short cylindrical collar running axially away from the end member is formed at the radialy outer region of the flange and lies in a close fit against the bore of the hollow cylindrical wall.

3. A valve tappet of claim 2 wherein the free end of the cylindrical collar is attached at at least some points of its periphery by welding or soldering to the bore of the hollow cylindrical wall.

4. A valve tappet of claim 2 wherein the free end of the cylindrical collar is fixed at at least some points of its periphery in the bore of the hollow cylindrical wall by local deformation of the wall by means of cold flow in the region of a wall shoulder.

5. A valve tappet of claim 1 wherein the flange is slightly inclined so that only its radially outermost region is in contact with the inner surface of the end member.

6. A valve tappet of claim 1 wherein the flange is propped against a shoulder of the hollow cylindrical wall so that it has no contact with the inner surface of the end member.

7. A valve tappet of claim 1 wherein the sleeve is supported at its end away from the end member by the disk member.

8. A valve tappet of claim 1 with a cylindrical jacket lying against the bore of the hollow cylindrical wall, the cylindrical jacket being fixed at its end away from the end member to the wall in a liquid-tight manner and defining together with the wall at at least one point in the periphery a longitudinal channel which at its end away from the end member is connected with an oil reservoir wherein the end face of the cylindrical jacket situated towards the end member supports a cylindrical collar.

* * * * *